US009494921B2

(12) United States Patent
Dionne

(10) Patent No.: US 9,494,921 B2
(45) Date of Patent: Nov. 15, 2016

(54) MAGNETIC SHIELDING FOR TIMEPIECE BALANCE SPRING

(75) Inventor: Jean-Francois Dionne, Kerzers (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 13/993,645

(22) PCT Filed: Dec. 5, 2011

(86) PCT No.: PCT/EP2011/071753

§ 371 (c)(1),
(2), (4) Date: Jun. 12, 2013

(87) PCT Pub. No.: WO2012/080021

PCT Pub. Date: Jun. 21, 2012

(65) Prior Publication Data

US 2013/0265859 A1 Oct. 10, 2013

(30) Foreign Application Priority Data

Dec. 15, 2010 (EP) ..... 10195192

(51) Int. Cl.

| | |
|---|---|
| ***G04B 15/00*** | (2006.01) |
| ***G04B 17/00*** | (2006.01) |
| ***G04B 17/20*** | (2006.01) |
| ***G04B 43/00*** | (2006.01) |
| ***G04B 17/22*** | (2006.01) |
| ***G04B 17/06*** | (2006.01) |

(52) U.S. Cl.

CPC ..... *G04B 43/00* (2013.01); *G04B 17/063* (2013.01); *G04B 17/20* (2013.01); *G04B 17/22* (2013.01); *G04B 17/222* (2013.01); *G04B 17/227* (2013.01); *G04B 43/002* (2013.01)

(58) Field of Classification Search

CPC .. G04B 17/06; G04B 17/063; G04B 17/222; G04B 17/28; G04B 18/006; G04C 3/04
USPC ..... 368/127–130, 158, 161, 168–178, 293
See application file for complete search history.

(56) References Cited

U.S. PATENT DOCUMENTS

| | | | | |
|---|---|---|---|---|
| 965,506 A * | 7/1910 | Ecaubert | ..... | 368/171 |
| 2,568,326 A | 9/1951 | Dubois | | |
| 3,002,138 A * | 9/1961 | Byrnes et al. | ..... | 318/132 |
| 3,335,561 A * | 8/1967 | Kurosawa | ..... | G04C 3/065 368/158 |

(Continued)

FOREIGN PATENT DOCUMENTS

| | | |
|---|---|---|
| CH | 122391 A | 9/1927 |
| CH | 289106 A | 2/1953 |

(Continued)

OTHER PUBLICATIONS

Suzuki et al., JP 4124246 English Translation, originally published Apr. 24, 1992, whole document.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

Device for protecting a timepiece balance spring (1) against interfering magnetic fields comprising a balance (2) made of amorphous ferromagnetic material.

14 Claims, 2 Drawing Sheets

(56) References Cited

U.S. PATENT DOCUMENTS

| | | | | |
|---|---|---|---|---|
| 3,943,701 | A * | 3/1976 | Poix | 368/173 |
| 8,414,184 | B2 * | 4/2013 | Mallet et al. | 368/170 |
| 2008/0025152 | A1 * | 1/2008 | Yano et al. | 368/47 |
| 2010/0054090 | A1 * | 3/2010 | Orny et al. | 368/175 |
| 2011/0038234 | A1 * | 2/2011 | Mignot et al. | 368/293 |
| 2011/0103196 | A1 * | 5/2011 | Buhler et al. | 368/169 |
| 2013/0176829 | A1 * | 7/2013 | Cusin et al. | 368/127 |

FOREIGN PATENT DOCUMENTS

| | | | |
|---|---|---|---|
| CH | 361247 | A | 3/1962 |
| CH | 689 106 | A5 | 10/1998 |
| CH | 692 218 | A5 | 3/2002 |
| EP | 2 230 570 | A2 | 9/2010 |
| FR | 1 408 872 | A | 8/1965 |
| FR | 2 000 706 | A1 | 9/1969 |
| FR | 2 063 101 | A1 | 7/1971 |
| JP | 04124246 | A * | 4/1992 |

OTHER PUBLICATIONS

Kilian et al., EP 2230570 English Translation, originally published Sep. 22, 2010, whole document.*

Laviolette, CH 361247 English Translation, originally published Mar. 31, 1962, whole document.*

International Search Report issued in corresponding application PCT/EP2011/071753, completed Feb. 29, 2013 and mailed Mar. 7, 2012.

* cited by examiner

MAGNETIC SHIELDING FOR TIMEPIECE BALANCE SPRING

This is a National Phase Application in the United States of International Patent Application PCT/EP2011/071753, filed Dec. 5, 2011, which claims priority on European Patent Application No. 10195192.9, filed Dec. 15, 2010. The entire disclosures of the above patent applications are hereby incorporated by reference.

FIELD OF THE INVENTION

The present invention relates to a device for protecting a mechanical timepiece balance spring against interfering magnetic fields originating from outside said timepiece.

BACKGROUND OF THE INVENTION

In mechanical timepieces, the material forming the balance spring is generally made from a metal alloy such as steel capable of remanent magnetisation if subjected to an external magnetic field. Although it is possible to envisage making the part in a non-magnetic material in order to neutralise the impact of an external magnetic field interfering with the operation of a mechanical timepiece of this type, the excellent mechanical qualities (ductility, elasticity, thermal expansion coefficient, etc.) of a balance spring made of conventional materials largely compensates for this drawback of magnetic sensitivity. Consequently, it has been sought to protect this type of balance spring from interfering fields, such that if the movement is subjected to a field of around 4.8 kA/m, the variation in rate does not exceed 30 seconds per day to comply with horological standards. Beyond this 4.8 kA/m field and without protection, the variation in rate is very variable and reaches significant variations of up to several minutes per day. This variation is due above all to the longitudinal magnetisation of the coils forming the balance spring, which produces torque on the balance axis to which the balance spring is connected. The torque is added to or subtracted from the normal mechanical torque. The variation in rate is also influenced, but to a lesser extent, by magnetostriction which tends to lengthen or shorten the strip forming the balance spring when it is subjected to a magnetic field.

To overcome this problem of magnetic insulation of the regulating member, devices have already been proposed which protect a timepiece against the interfering influence of external magnetic fields of any type, such as for example external fields from permanent magnets or electric motors of any type.

The simplest and most radical solution also consists in completely shielding the timepiece movement to prevent penetration by any interfering field lines. This is the case proposed by CH Patent No 122391 where the watch movement is protected by a set of elements formed of a corrosion resistant alloy, with high permeability and low hysteresis, forming a magnetic screen. The elements are a depressed portion arranged between the movement and the back cover of the watch, a dust proof ring forming a dome disposed between the movement and the casing ring, and an intermediate plate disposed between the bottom plate and the dial of the watch. This method is extremely cumbersome and expensive. Indeed, it requires three extra parts which not only make the watch heavier but also increase its volume.

FR Patent No 1 408 872 discloses a lighter and less cumbersome solution than that proposed above. Here however, the watch movement is not completely surrounded with a highly permeable material, but only the back cover and periphery thereof. The device is thus formed by a case element having sufficient permeability to magnetic fields. The case element is supplemented by a soft steel casing ring with which it forms a depressed portion surrounding the movement and forming a magnetic screen. The case element is the back cover of the case, made of stainless, polishable steel with a homogeneous ferritic structure. Thus, in this embodiment, there is no addition of extra parts, since the back cover and the casing ring are actually made of highly magnetically permeable materials. Moreover, there is no screen disposed between the movement and watch dial, since the protective device is limited to a depressed portion with no cover which serves as a housing for the watch movement.

A first drawback of this latter solution however, is that the actual balance spring is not protected against an interfering field whatever the orientation of the field prevailing in the balance spring plane. Indeed, since the balance spring is off-centre relative to the centre of the movement, and if omnidirectional protection is required, a device is proposed that is centred relative to said balance spring and not relative to the movement as a whole as is the case of the aforecited document. Another drawback of this solution is that the movement is totally concealed, which is detrimental to the aesthetics of a watch, particularly for high-end watches.

Balances are also known which are made of ferromagnetic materials in electronic watches, such as, for example, in the watches described in FR Patent No 2063101 or CH Patent No 361247. The ferromagnetic material employed for the balance does not, however, constitute a magnetic shielding for improving the isochronism of the balance spring, but is intended to cooperate with an electromagnetic circuit maintaining oscillations. FR Patent No 2000706 is an example of a similar solution for an electronic watch comprising a ferromagnetic balance-regulator which has no balance spring at all.

Finally, there are known from CH Patent No 689106 balance springs made with particular alloys having advantageous elastic and thermo-elastic properties for a fastening with a nickel balance. However, no particular magnetic shielding properties are mentioned for the balance in relation to the balance spring.

Consequently, it is an object of the present invention to provide a solution which aims to improve the magnetic shielding of a balance spring and which does not have the above limitations.

SUMMARY OF THE INVENTION

These objects are achieved by the main claim of the invention which not only conforms to the statements of the first paragraph above, but is original in that the protective device comprises a balance formed of an amorphous ferromagnetic material.

One advantage of the proposed solution is that it provides efficient magnetic shielding because of the advantageous magnetic and anti-corrosive properties of amorphous metals, and also advantageously reuses certain existing elements of the movement as shielding elements, and therefore does not require any supplementary parts or particular surface treatment. The space required is therefore reduced to a minimum, as are production costs. An additional advantage of the solution is that it provides a magnetic shield centred on the axis of rotation of the balance spring to improve the efficiency of said balance spring.

Another advantage of the proposed solution is that it enables the movement components to be seen through the back cover of the watch, thus improving the overall aesthetics of the timepiece.

BRIEF DESCRIPTION OF THE DRAWINGS

The invention will now be explained in detail below via several embodiments given by way of non-limiting example, and these embodiments are illustrated by the annexed drawings, in which.

DETAILED DESCRIPTION

Nowadays, when the density of electromagnetic interference is greatly increasing, particularly because of new generation wireless cellular (3G) and mobile (wifi) networks, but also because of the increase in the number of small permanent magnets used for fastening handbags or mobile telephone cases for example, it is important to find magnetic shielding solutions today that can guarantee the isochronism of regulating systems for mechanical watches.

In doing so, the watchmaker is however faced with a problem of space for housing the shielding on the bottom plate and inside the case. Consequently, it has been sought to find optimum solutions which combine maximum compactness with efficient attenuation of the magnetic field.

Rather than attempting to decrease or completely remove the interfering magnetic field from the balance spring by complicated, cumbersome solutions, it seems wiser to orient or deviate the interfering field, without necessarily decreasing or removing it, in directions where it is less damaging from the point of view of its potential to polarize the magnetic material forming the balance spring.

Figure 1A:
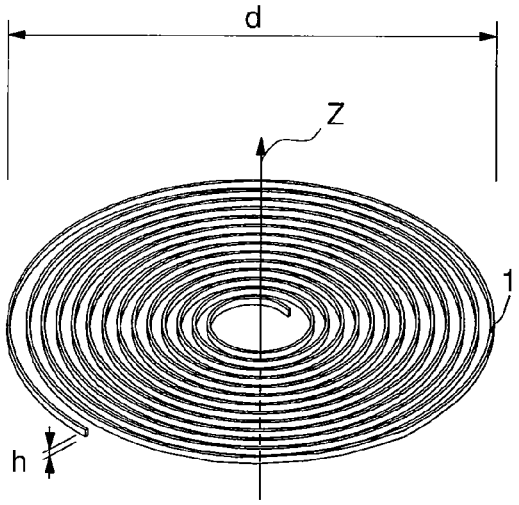
FIGS. 1A and 1B show perspective plan views of a balance spring and a portion of the spring.
Figure 1B:
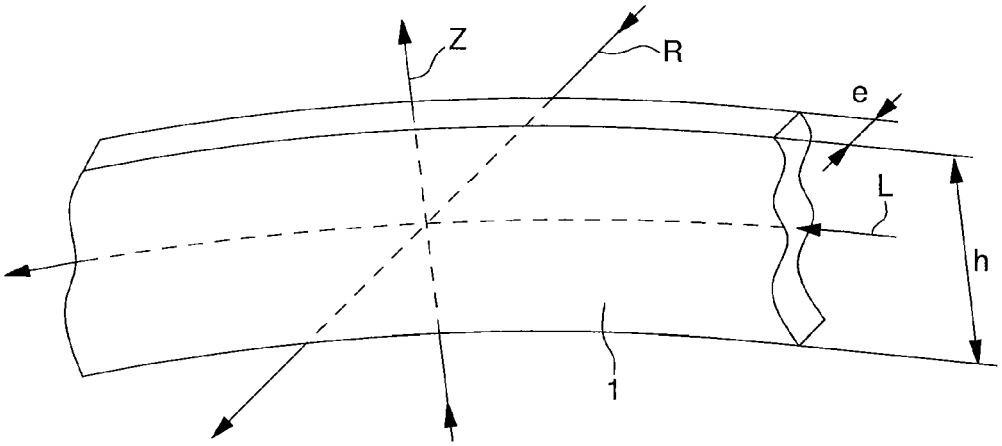
Figure 4:
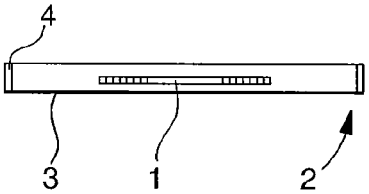

The regulating member of a mechanical watch is generally formed of a balance spring, as illustrated in FIG. 1A. The balance spring is mounted about an axis of rotation Z and is wound in a perpendicular plane to said axis. The diameter of the balance spring in this plane is referenced d, whereas the height of the balance spring along axis Z is referenced h. FIG. 1B shows a portion of balance spring 1 which is a very long strip wound about itself. The strip is preferably of reduced height h and very low thickness e. Consequently, if the strip is polarized in the direction of height Z or orthogonally, or even in the direction of thickness R or radially, little or no remanent magnetisation will remain. However, polarisation in the direction of length L should be avoided since it is the only direction, especially on the outer coils of the balance spring, which will cause residual magnetisation therein, resulting, as seen above, in an additional stray torque causing random variation in the return torque of the balance spring, which affects the isochronism of the regulating system. To prevent or greatly decrease this longitudinal polarisation, it is consequently sufficient to orient the field lines in a more or less orthogonal and radial configuration to the plane of balance spring 1.

Figure 2:
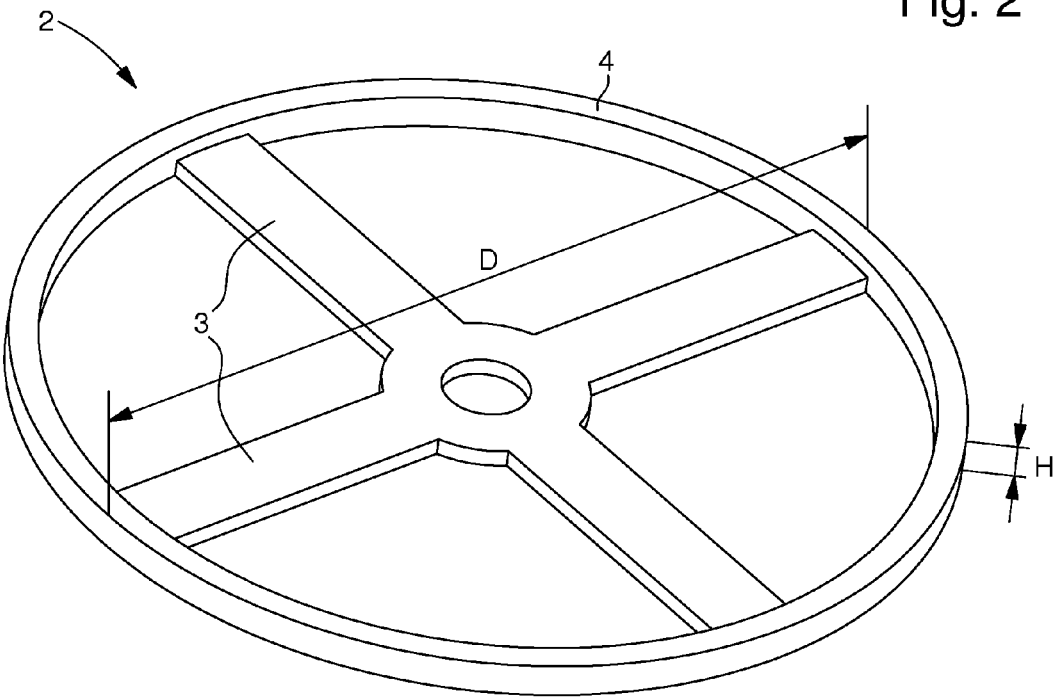
FIG. 2 is a schematic perspective view of a preferred embodiment of the invention.

In order to maximise compactness, it is advantageously sought, within the scope of the invention, to use existing components of the movement so that no additional space is required for the magnetic shielding of a given calibre. FIG. 2 shows a preferred embodiment of balance 2 comprising four branches which seems to be the most suitable element, because of the positioning of its arms 3 in a parallel plane to the plane of balance spring 1, and the symmetrical configuration of these arms relative to the axis of rotation Z of balance spring 1. This symmetrical arrangement of arms 3 relative to axis of rotation Z and the shielding provided by casing ring 4, which is coaxial to the balance spring and has a height H which is preferably chosen to be considerably greater than the balance spring height h, not only greatly attenuates the amplitude of the magnetic field applied to the interior of the space in which balance spring 1 rests, until the field induced in casing ring 4 saturates, but also provides omnidirectional protection relative to the interfering magnetic field, regardless of the orientation of this field.

Casing ring 4 further efficiently protects balance spring 1 from interfering magnetic fields, since a larger number of these fields are deviated in the vertical direction of axis of rotation Z, which is a polarizing direction along which the balance spring is less sensitive. It will be noted, however, that the concentration of the field at the periphery of arms 3 and on ring 4 still tends to increase the field locally, hence the need to provide a casing ring 4 of relatively large diameter D compared to the diameter d of balance spring 1, preferably at least two times greater, so that no part of the balance spring, even the outermost part thereof, is subject to this undesirable concentration effect. In order to improve the level of saturation of the field induced in casing ring 4, it is possible to increase the section of the ring; however a compromise must also be found with respect to the moment of inertia of the balance, which must be kept at a relatively low level to reduce the stresses exerted by balance spring 1. In order to increase the height of casing ring 4 without increasing its mass, the most tapered section possible could be chosen with, for example, a ratio of more than 10 between the height and width of said section. Thus the polarisation of the field lines will be more efficient in vertical direction Z.

The step of producing parts of the movement made of ferromagnetic material, i.e. having very high magnetic sensitivity (generally indicated by the Greek letter x), has never been considered before by those skilled in the art because of the strong propensity of usual ferromagnetic materials to oxidise, particularly because of the presence of iron and the lack of chromium in such alloys. It is, however, now possible to treat the surface of these types of materials with anti-corrosion agents to prevent this problem, without modifying their magnetic properties. The high magnetic saturation material used to make casing ring 4 and arms 3 is an iron-based amorphous metal, such as for example an iron-nickel or iron-cobalt alloy, or iron-nickel-molybdenum or iron-nickel-copper alloy. This type of alloy is renowned for its low coercive and highly magnetically permeable properties, i.e. with very narrow hysteresis cycles, and with a very high slope, and is also very resistant to corrosion and thus particularly well suited to implementing the invention. The chemical nature of the alloy is selected so that the magnetic behaviour of the material has high magnetic permeability and a high saturation level such as, for example, Permenorm iron-nickel alloys with 45 to 50% nickel content.

According to the preferred embodiment illustrated in FIG. 2, balance 2 comprises at least four flattened arms which extend in the plane in which the balance spring is wound. When the watch is used, the balance is permanently activated in rotation and an essentially flat surface is emulated to form a magnetic shield in this plane. According to the illustrated variant, where attenuation is around half between an external field and the field where balance spring 1 is located, the diameter d and height h of which preferably conform to the ratios set out above with respect to the diameter and height D, H of casing ring 4.

To improve shielding efficiency further, it is possible to increase the number of arms and/or the thickness thereof so as to increase the protective surface area. When the plurality of arms 3 covers a surface area equal to more than a quarter of the virtual disc delimited by casing ring 4 in the plane of rotation of arm 3, the measured attenuation of interference in variation of rate was in ratios of more than 3 especially for induction values of more than 10 millitesla (mT), i.e. around 8 kA/m for a balance with three arms with the aforecited surface ratio with respect to the virtual disc delimited by the casing ring. It is possible to improve these ratios further, up to values of 6-7 with a solid disc instead of arms 3. This solution has the drawback, however, of increasing the mass of the system and consequently the moment of inertia and energy used. Thus, to avoid increasing the total mass of the system, it is preferable to use arms which are flattened as much as possible for a given mass, i.e. whose dimensions extend as far as possible into their plane of rotation, so that the polarization of the field is optimum in vertical direction Z. Regardless of the number of arms used within the scope of the invention, the arms will be referred to flattened when the ratio between the width and length of their section is more than around 10, so that they cover the largest possible surface area in the plane of the virtual disc delimited by casing ring 4.

To produce these flattened arms for the balance, the amorphous metal alloy used within the scope of the invention is particularly advantageous here because of the properties of elastic deformation and mechanical resistance it provides, which means that a very flattened shape is easy to obtain for a given mass. This flattened shape means that the external magnetic field lines can be more efficiently oriented without any need to increase the mass of the balance, and consequently its moment of inertia, which would be detrimental to the efficiency of the regulating system for a given balance spring.

Figure 3:
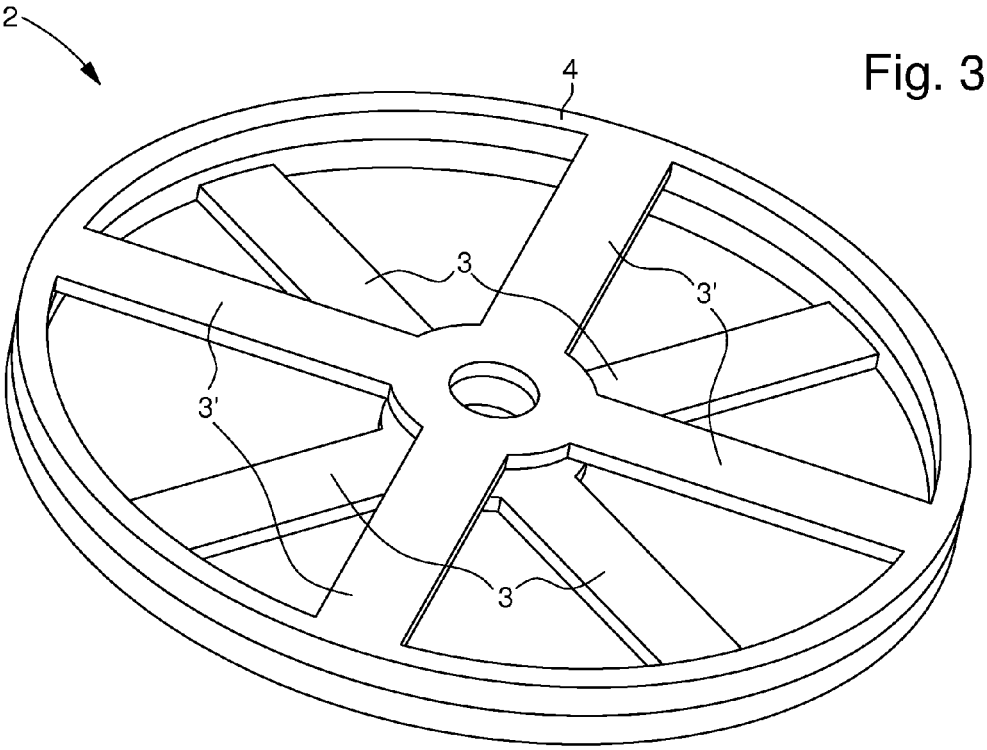
FIG. 3 is a schematic perspective view of an alternative embodiment of the invention.

To further improve magnetic shielding efficiency, the device of the invention could include a second series of arms 3' mounted on top of said casing ring 4, as illustrated in FIG. 3. The series of arms 3' could preferably be angularly shifted, or of different, or complementary but symmetrical geometrical shapes. It is also possible to envisage two series of arms identical to the series of bottom arms 3, so that the first series of arms 3 and second 3' are superposed on each other. The advantage of covering the top of the magnetic shield with rotating arms, on the one hand, is that it forms a symmetrical and totally enclosed space inside which balance spring 1 is arranged, which makes the shielding efficient both in terms of attenuation and isotropy. On the other hand, like the attenuation values measured just with the arms 3, the mass efficiency of the shield is greatly improved compared to a solid surface like a disc. The part forming the balance with two series of arms 3, 3' could be formed in a single piece, for example via a LIGA type process, or by fitting a rib into a groove of male-female parts each comprising a series of arms and each forming a portion of casing ring 4.

Those skilled in the art will also observe that one advantage of all the proposed embodiments is that the view of the movement is not obstructed, particularly by the back cover of the case, as is usually the case with shields. This possibility could consequently be used for making skeleton or tourbillon watches where at least one portion of the movement is intended to be seen by the user.

The invention claimed is:

1. A device for protecting a balance spring of a mechanical timepiece against interfering magnetic fields originating outside said timepiece, the device comprising:

a balance comprising a casing ring and a symmetrical arrangement of arms relative to an axis of rotation of the balance spring, said arms extending radially outward in a plane perpendicular to said axis and terminating at the casing ring, wherein the symmetrical arrangement of arms comprises a first series of arms and a second series of arms mounted on the casing ring above said first series of arms, wherein a ratio between a height of the casing ring in a direction parallel to said axis and a width of the casing ring in a direction perpendicular to said axis is more than 10, wherein a ratio between a width of each arm of said arms in the direction perpendicular to said axis and a height of said each arm of said arms in the direction parallel to said axis is more than 10, and wherein a material of the balance is an amorphous ferromagnetic alloy.

2. The device according to claim 1, wherein the symmetrical arrangement of arms comprises at least four flattened arms.

3. The device according to claim 1, wherein a combined surface area of the symmetrical arrangement of arms in the plane perpendicular to said axis is greater than a quarter of a total surface area delimited by an inner diameter of the casing ring in said plane.

4. The device according to claim 1, wherein the balance has an outer diameter at least two times greater than a diameter of the balance spring.

5. The device according to claim 1, wherein the amorphous ferromagnetic alloy is at least one of an iron-nickel alloy, an iron-cobalt alloy, an iron-nickel-molybdenum alloy, and an iron-nickel-copper alloy.

6. The device according to claim 1, wherein the height of the casing ring is substantially greater than a height of the balance spring in the direction parallel to said axis.

7. The device according to claim 1, wherein the casing ring comprises a continuous ring around a perimeter of the balance.

8. A device for protecting a balance spring of a mechanical timepiece against interfering magnetic fields originating outside the timepiece, the device comprising:

a balance comprising a casing ring and a symmetrical arrangement of arms relative to an axis of rotation of the balance spring, said arms extending radially outward in a plane perpendicular to said axis and terminating at the casing ring, wherein the symmetrical arrangement of arms comprises a first series of arms and a second series of arms mounted on the casing ring above said first series of arms, wherein a ratio between a height of the casing ring in a direction parallel to said axis and a width of the casing ring in a direction perpendicular to said axis is more than 10, wherein a ratio between a width of each arm of said arms in the direction perpendicular to said axis and a height of said each arm of said arms in the direction parallel to said axis is more than 10, wherein a material of the balance is an amorphous ferromagnetic alloy, and wherein the device is configured for protecting the balance spring of the mechanical timepiece without obstructing visibility of at least a portion of a movement of said timepiece.

9. The device according to claim 8, wherein the symmetrical arrangement of arms comprises at least four flattened arms.

10. The device according to claim 8, wherein a combined surface area of the symmetrical arrangement of arms in the plane perpendicular to said axis is greater than a quarter of a total surface area delimited by an inner diameter of the casing ring in said plane.

11. The device according to claim 8, wherein the balance has an outer diameter at least two times greater than a diameter of the balance spring.

12. The device according to claim 8, wherein the amorphous ferromagnetic alloy is at least one of an iron-nickel alloy, an iron-cobalt alloy, an iron-nickel-molybdenum alloy, and an iron-nickel-copper alloy.

13. The device according to claim 8, wherein the height of the casing ring is substantially greater than a height of the balance spring in the direction parallel to said axis.

14. The device according to claim 8, wherein the casing ring comprises a continuous ring around a perimeter of the balance.

* * * * *